US012209488B2

(12) United States Patent
Zhang et al.

(10) Patent No.: US 12,209,488 B2
(45) Date of Patent: Jan. 28, 2025

(54) FRACTURING APPARATUS

(71) Applicant: YANTAI JEREH PETROLEUM EQUIPMENT & TECHNOLOGIES CO., LTD., Shandong (CN)

(72) Inventors: Peng Zhang, Shandong (CN); Weipeng Yuan, Shandong (CN); Rikui Zhang, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 61 days.

(21) Appl. No.: 18/056,571

(22) Filed: Nov. 17, 2022

(65) Prior Publication Data

US 2024/0018860 A1 Jan. 18, 2024

Related U.S. Application Data

(63) Continuation of application No. PCT/CN2022/105894, filed on Jul. 15, 2022.

(51) Int. Cl.

| | |
|---|---|
| ***E21B 43/26*** | (2006.01) |
| ***E21B 36/00*** | (2006.01) |
| ***E21B 36/04*** | (2006.01) |

(52) U.S. Cl.

CPC ..... *E21B 43/2607* (2020.05); *E21B 36/006* (2013.01); *E21B 36/04* (2013.01)

(58) Field of Classification Search

CPC ..... E21B 36/04; E21B 36/006; E21B 43/2607

See application file for complete search history.

(56) References Cited

U.S. PATENT DOCUMENTS

| | | | | |
|---|---|---|---|---|
| 2007/0125544 | A1* | 6/2007 | Robinson | E21B 43/30 166/305.1 |
| 2010/0000508 | A1* | 1/2010 | Chandler | E21B 43/267 165/104.34 |
| 2012/0255734 | A1* | 10/2012 | Coli | E21B 43/267 166/305.1 |
| 2015/0197459 | A1* | 7/2015 | Hill, Jr. | C05F 17/20 71/25 |
| 2017/0145918 | A1* | 5/2017 | Oehring | F02C 7/22 |
| 2019/0299128 | A1* | 10/2019 | Arefi | B01D 21/34 |
| 2022/0341358 | A1* | 10/2022 | Ji | F01D 15/10 |
| 2023/0048551 | A1* | 2/2023 | Feng | F04B 23/04 |

* cited by examiner

*Primary Examiner* — Giovanna Wright
*Assistant Examiner* — Ronald R Runyan
(74) *Attorney, Agent, or Firm* — Crowell & Moring LLP

(57) ABSTRACT

A fracturing apparatus, comprising: a plurality of portions to be heated; a heating system for heating each of the portions to be heated; and an auxiliary power unit, which is configured to at least provide power for a heating operation by the heating system. When the fracturing apparatus operates in a cold area, each of the portions to be heated can be heated by the heating system, so as to ensure the normal start-up and operation effect of the fracturing apparatus.

18 Claims, 12 Drawing Sheets

FRACTURING APPARATUS

CROSS REFERENCE TO RELATED APPLICATION

The present application is a continuation application and claims priority to a PCT Patent Application No. PCT/CN2022/105894, filed Jul. 15, 2022, the entire contents of which being incorporated herein by reference.

TECHNICAL FIELD

The present disclosure relates to a fracturing apparatus used for the oil field, and specifically to a turbine fracturing apparatus with a heating system.

BACKGROUND

In the field of oil and gas extraction, fracturing operation refers to a technology that uses high-pressure fracturing fluid to form fractures in the oil and gas layer during oil or gas production. The fractures can be formed in the oil and gas layer by the fracturing operation so that the flow environment of oil and gas in the underground can be improved, thereby increasing the production of oil wells. Therefore, fracturing operation is a main method of increasing the production in the oil and gas field exploitation. An apparatus that can perform the fracturing operation is called a fracturing apparatus.

Currently, in cold area, before the fracturing apparatus operates, it is necessary to heat all the operational components, otherwise it will affect the operation effect of the fracturing apparatus, and even the normal start-up of the fracturing apparatus.

However, in the prior art, the heating rate of the heating device of the turbine fracturing apparatus is relatively slow, resulting in a long heating time of the heating device, increased the energy consumption of the heating device, and reduced heating efficiency of the heating device.

SUMMARY

The technical problem to be solved by the present disclosure is to make improvement with respect to the situation that the heating of the devices is slow and the heating time is relatively long in the prior art.

The technical problem to be solved by the present disclosure is realized through the following solutions.

A fracturing apparatus, comprising: a plurality of portions to be heated; a heating system for heating each of the portions to be heated; and an auxiliary power unit, which is configured to at least provide power for a heating operation by the heating system.

Further, the heating system includes a heating device as a heat source.

Further, the auxiliary power unit is an electric motor, the heating device is an instantaneous electric heater that is in direct contact with each of the portions to be heated so as to heat each of the portions to be heated, and the electric motor can power the instantaneous electric heater.

Further, the auxiliary power unit is an engine, and the heating device is an electric heater, a gas heater or an oil heater that heats each of the portions to be heated by heating a circulating medium.

Further, the engine and/or the heating device are/is used as a heat source of the heating system.

Further, the heating system further includes a medium flow pipeline and a circulating pump, the antifreeze of the engine or water as a circulating medium is heated by the heat source to change into a hot medium, the hot medium is made to flow to each of the portions to be heated through the medium flow pipeline under the action of the circulating pump so as to heat each of the portions to be heated, and the hot medium changes into a cold medium after heating each of the portions to be heated, then returns to the engine and is heated again by the heat source so as to realize the function of circulating heating.

Further, in a case where only the engine is used as the heat source of the heating system, the heating device is bypassed outside the heating system.

Further, the heating system further includes a medium distribution portion and a medium converging portion, wherein the hot medium is distributed to each of the portions to be heated through the medium distribution portion, and the cold medium flows into the medium converging portion to be centrally circulated back to the engine.

Further, the portions to be heated are lubricating oil, engine antifreeze, hydraulic oil, fuel oil, battery box, heat exchanger, and air intake cabin of turbine engine.

Further, each of the portions to be heated can be heated in a series manner or a parallel manner, preferably in a parallel manner.

Further, the heating device is a plurality of instantaneous electric heaters that are in direct contact with each of the portions to be heated so as to heat each of the portions to be heated, the plurality of instantaneous electric heaters are connected in series or in parallel, preferably in parallel; or the heating device is a plurality of heat exchangers that heat each of the portions to be heated by heating the circulating medium, and the plurality of heat exchangers are connected in series or in parallel, preferably in parallel.

Further, when the portion to be heated is a liquid medium, the portion to be heated is further provided with a circulating pump, wherein one end of the circulating pump is connected to a liquid medium outlet of the portion to be heated, and the other end of the circulating pump is connected to a liquid medium inlet of the portion to be heated, so that the liquid medium can circulate through the circulating pump while being heated.

Further, there are two filters further provided between the circulating pump and the portion to be heated, wherein one of the filters is provided between the one end of the circulating pump and the liquid medium outlet of the portion to be heated, and the other one of the filters is provided between the other end of the circulating pump and the liquid medium inlet of the portion to be heated, so that solid impurities in the liquid medium can be filtered out so as to prevent clogging of the circulating pump.

Further, the heating system further includes an automatic control system, which can automatically control the heating of each of the portions to be heated.

Further, each of the portions to be heated is provided with a temperature sensor, and the automatic control system can automatically control the heating of each of the portions to be heated through the temperature supplied by the temperature sensor.

Further, each of the portions to be heated is provided with a temperature sensor, and a ball valve is provided at the medium converging portion, the ball valve can control whether the heating pipeline for each of the portions to be heated can be flowed through, the automatic control system can automatically control the opening and closing of the ball valve through the temperature supplied by the temperature sensor, so as to automatically control the heating of each of the portions to be heated.

Further, the fracturing apparatus further includes a turbine engine, the turbine engine includes an air intake cabin, and inertia separators and filters are sequentially arranged along a direction from the outer side close to the cabin wall toward the center of the cabin in the air intake cabin.

Further, the heating system includes the heating device provided in the air intake cabin, and the heating device can be provided at a position outside the inertia separators or can be provided at a position between the inertia separators and the filters.

Further, the air intake cabin is further provided with a temperature sensor and a differential pressure sensor, wherein the temperature sensor can detect the temperature of the environment, and the differential pressure sensor can detect an air intake pressure differential of the air entering the air intake cabin from the environment.

Further, the heating device is instantaneous electric heaters or heat exchangers for heating with a circulating medium.

Further, the fracturing apparatus further includes an automatic control system, the automatic control system automatically controls the heating by the heating device according to the temperature supplied by the temperature sensor and the pressure differential supplied by the differential pressure sensor.

The technical solutions of the present disclosure will be described in detail below with reference to the accompanying drawings and specific embodiments.

DETAILED DESCRIPTION

Figure 1:
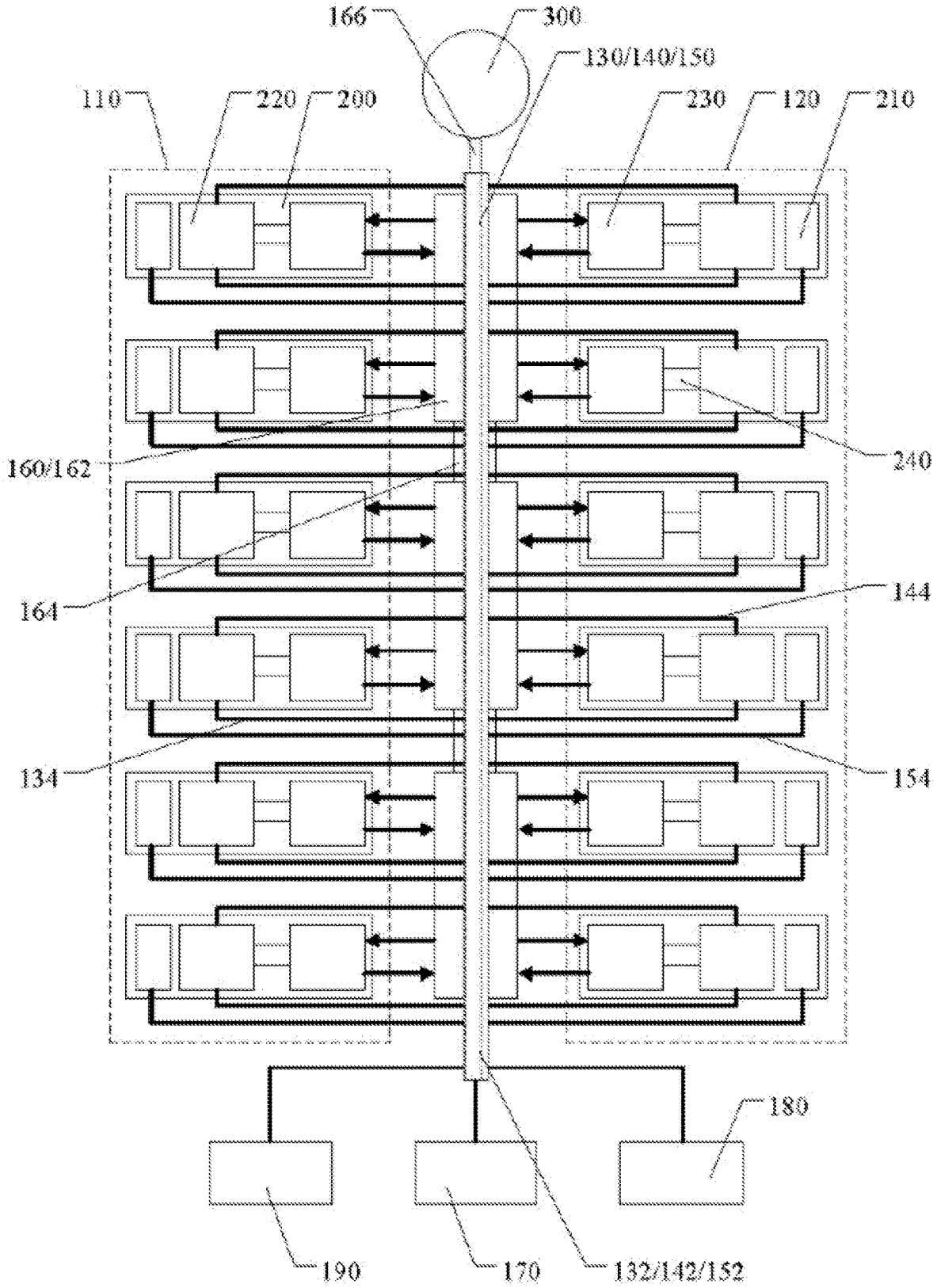
FIG. 1 is a schematic diagram illustrating an example fracturing system of the present disclosure.

FIG. 1 is a schematic diagram illustrating a fracturing system. As shown in FIG. 1, a fracturing system 100 comprises a first fracturing apparatus group 110, a second fracturing apparatus group 120, a gas pipeline 130, a compressed air pipeline 140 and an auxiliary energy pipeline 150; the first fracturing apparatus group 110 includes N turbine fracturing apparatuses 200 as power devices; the second fracturing apparatus group 120 includes M turbine fracturing apparatuses 200; the gas pipeline 130 is connected to the first fracturing apparatus group 110 and the second fracturing apparatus group 120, respectively, and is configured to supply gas to N+M turbine fracturing apparatuses 200; the compressed air pipeline 140 is connected to the first fracturing apparatus group 110 and the second fracturing apparatus group 120, respectively, and is configured to supply compressed air to N+M turbine fracturing apparatuses; each of the turbine fracturing apparatuses 200 includes an auxiliary device 210, and the auxiliary energy pipeline 150 is connected to the first fracturing apparatus group 110 and the second fracturing apparatus group 120, respectively, and is configured to supply auxiliary energy to the auxiliary devices 210 of the N+M turbine fracturing apparatuses 200, in which each of N and M is a positive integer greater than or equal to 2.

In the fracturing system 100, the fracturing operation can be performed using a plurality of turbine fracturing apparatuses in groups, thereby improving the displacement and efficiency. On the other hand, the fracturing system also integrates the gas pipeline, the compressed air pipeline and the auxiliary energy pipeline of a plurality of turbine fracturing apparatuses, thereby facilitating safety management and equipment maintenance and avoiding safety accidents.

As shown in FIG. 1, the values of M and N may be equal, for example, both are 6. Of course, it is not limited to this, and the values of M and N may not be equal.

It is to be noted that the auxiliary device 210 of each of the turbine fracturing apparatuses 200 may include an auxiliary power unit, such as an engine or an electric motor, etc., and the auxiliary power unit may provide power for the operation of some devices in the turbine fracturing apparatus 200, such as but not limited to providing power for the heating operation of the heating device. As shown in FIG. 1, the auxiliary device 210 of each of the turbine fracturing apparatuses 200 may include a diesel engine, and the auxiliary energy pipeline 150 is configured to convey the diesel fuel. In some examples, the auxiliary device 210 may further include an oil pump, a hydraulic system, and a hydraulic motor; the diesel engine may drive the oil pump, thereby driving the hydraulic system; the hydraulic system drives the hydraulic motor to complete various auxiliary tasks, such as starting the turbine engine, driving the radiator, etc. Of course, it is not limited to this, and the auxiliary device 210 may further include a lubricating system and a lubricating oil pump, and the diesel engine may drive the lubricating oil pump, thereby driving the lubricating system to operate. In addition, as shown in FIG. 1, the auxiliary device 210 of each of the turbine fracturing apparatuses 200 may include an electric motor, and the auxiliary energy pipeline 150 is configured to transmit electric power. As mentioned above, the auxiliary device 210 can include an oil pump, a hydraulic system and a hydraulic motor, then the electric motor can drive the oil pump, thereby driving the hydraulic system; the hydraulic system drives the hydraulic motor to complete various auxiliary tasks, such as starting the turbine engine, driving the radiator to work etc. Likewise, the electric motor can drive the lubricating oil pump, thereby driving the lubrication work.

As shown in FIG. 1, each of the turbine fracturing apparatuses 200 includes a turbine engine 220, a fracturing pump 230 and a transmission mechanism 240; the turbine engine 220 is connected to the fracturing pump 230 through the transmission mechanism 240. The turbine engine 220 can be used as a power device to provide power for the fracturing pump 230, so that the fracturing pump 230 can perform fracturing operation.

As shown in FIG. 1, the gas pipeline 130 includes a main gas pipeline 132 and a plurality of gas branch pipelines 134 connected to the main gas pipeline 132; the compressed air pipeline 140 includes a main compressed air pipeline 142 and a plurality of compressed air branch pipelines 144 connected to the main compressed air pipeline 142; the auxiliary energy pipeline 150 includes an main auxiliary energy pipeline 152 and a plurality of auxiliary energy branch pipelines 154 connected to the main auxiliary energy pipeline 152. The main gas pipeline 132, the main auxiliary energy pipeline 152 and the main compressed air pipeline 142 are arranged between the first fracturing apparatus group 110 and the second fracturing apparatus group 120, so as to facilitate the safety management and equipment maintenance for the gas pipeline, auxiliary energy pipeline and compressed air pipeline.

As shown in FIG. 1, the fracturing system 100 further includes a manifold system 160 located between the first fracturing apparatus group 110 and the second fracturing apparatus group 120 and configured to convey fracturing fluid. Here, the main gas pipeline 132, the main auxiliary energy pipeline 152 and the main compressed air pipeline 142 are fixed at the manifold system 160. Therefore, the fracturing system integrates the manifold system for conveying fracturing fluid, the gas pipeline, the compressed air pipeline and the auxiliary energy pipeline, which can further facilitate safety management and equipment maintenance.

As shown in FIG. 1, the manifold system 160 includes at least one high and low pressure manifold skid 162; each high and low pressure manifold skid 162 is connected to at least one turbine fracturing apparatus 200 and is configured to convey low pressure fracturing fluid to the turbine fracturing apparatus 200 and collect the high pressure fracturing fluid output from the turbine fracturing apparatus. For example, as shown in FIG. 1, each high and low pressure manifold skid 162 is connected to four turbine fracturing apparatuses 200. Of course, the number of the turbine fracturing apparatuses connected to each high and low pressure manifold skid can be set according to the actual situation. As shown in FIG. 1, the manifold system 160 may include a plurality of high and low pressure manifold skids 162; the plurality of high and low pressure manifold skids 162 may be connected through first high pressure pipes 164. As shown in FIG. 1, the manifold system 160 further includes a second high pressure pipe 166 that communicates with the fracturing wellhead 300.

As shown in FIG. 1, the fracturing system 100 further includes a gas supply device 170, a compressed air supply device 180 and an auxiliary energy supply device 190; the gas supply device 170 is connected to the gas pipeline 130, the compressed air supply device 180 is connected to the compressed air pipeline 140, and the auxiliary energy supply device 190 is connected to the auxiliary energy pipeline 150.

The basic configuration of the fracturing system 100 has been described above.

However, as mentioned above, before the turbine fracturing apparatus 200 operates in a cold area, each of the execution components needs to be heated, otherwise it will affect the operation of the fracturing apparatus, and even the normal start-up of the fracturing apparatus. Based on this, the inventors of the present application propose a solution to improve the heating of fracturing apparatus. It is to be noted that, since the fracturing apparatus involves many components, the following description will focus on the related components such as the heating system, the auxiliary power unit and the portions to be heated of the fracturing apparatus in order to emphasize the key points of the present disclosure. The detailed solution is as follows.

Figure 2:
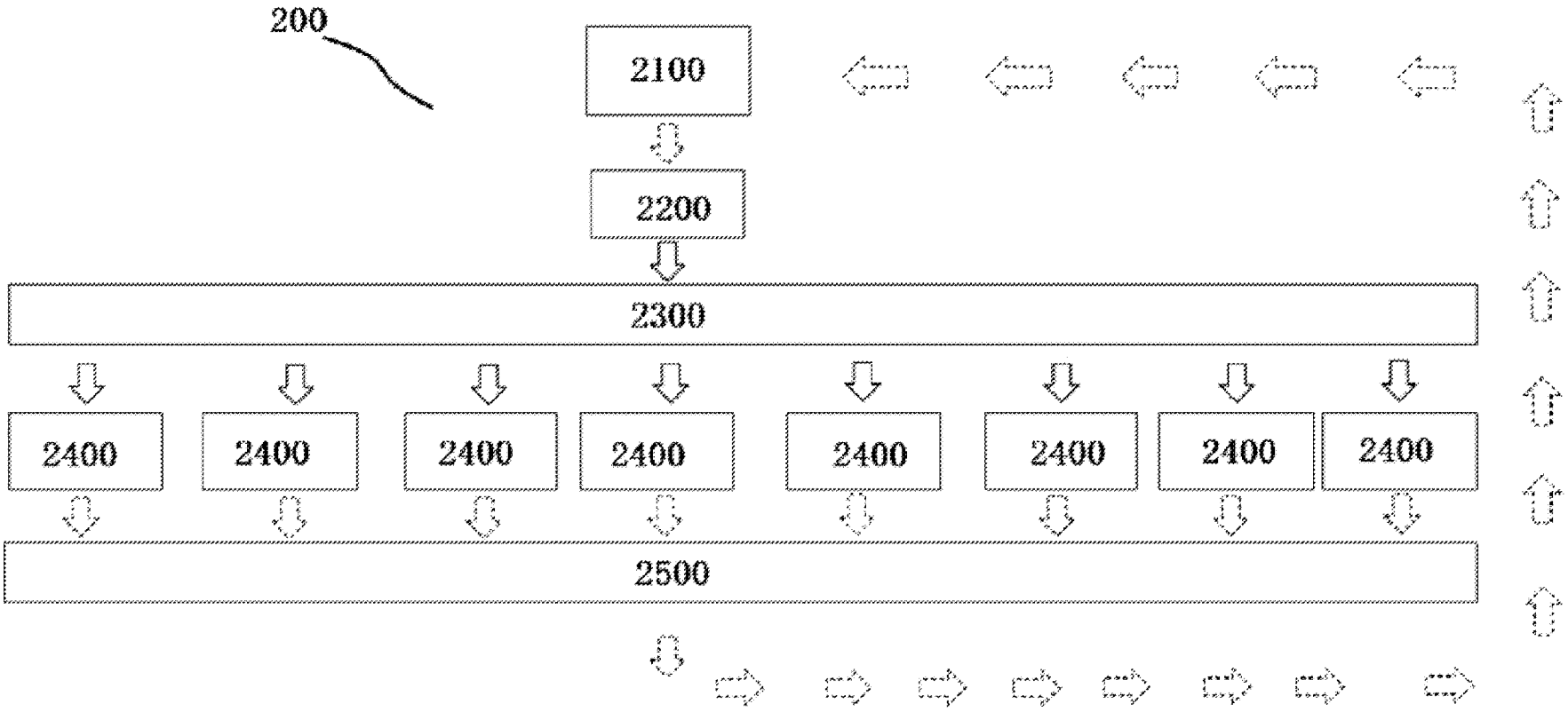
FIG. 2 is a schematic diagram illustrating an example fracturing apparatus employing a forward heating system of the present disclosure.

First, the description will be given with reference to FIG. 2. FIG. 2 is a schematic diagram illustrating a turbine fracturing apparatus 200 employing a forward heating system of the present disclosure. The turbine fracturing apparatus 200 may include an engine 2100 as an auxiliary power unit, a heating device 2200, a medium distribution portion 2300, a plurality of portions to be heated 2400 and a medium converging portion 2500. It is to be noted that the heating device 2200 and/or the engine 2100 can be used as the heat source of the heating system of the present disclosure. In addition to the heating device 2200 and/or the engine 2100 serving as a heat source, the heating system of the present disclosure further includes a circulating pump for circulating the medium and a power device for driving the circulating pump (they are not shown in FIG. 2). The circulating pump for circulating the medium and the power device for driving the circulating pump are not particularly limited, as long as the circulating pump can circulate the medium in the circulating pipeline and the power device can provide power for the circulating pump. The heating device 2200 may be an electric heater, a gas heater, an oil heater, or the like. For example, the heating device may be a heating furnace or the like.

In a case where only the heating device 2200 is used as a heat source, the heating system of the present disclosure can heat each of the portions to be heated 2400 of the turbine fracturing apparatus 200 in a forward heating manner. Specifically, as shown in FIG. 2, the heating device 2200 can heat a cold medium (such as water or engine antifreeze, etc.) in a low temperature state to make it reach a certain high temperature state, and then the heated hot medium is distributed to the plurality of portions to be heated 2400 (i.e., the cold source components), where heat is exchanged between the medium and the cold source components, thereby increasing the temperature of the cold source components to achieve the purpose of heating. Here, the heating system further includes the medium distribution portion 2300, a medium flow pipeline, heat exchangers located in the cold source components and the medium converging portion 2500. It is to be noted that the medium flow pipeline can be appropriately designed according to the positions of the heating device and each of the cold source components, so that the hot medium heated by the heating device can flow to the locations of each of the cold source components through the medium flow pipeline so as to heat each of the cold source components through heat exchange, and the medium is then returned to the heating device after heat exchange. Here, although the specific design of the medium flow pipeline is not shown in FIG. 2, the flow direction of the medium is shown. The dashed arrows indicate the flow direction of the cold medium (cold water or cold antifreeze), and the solid arrows indicate the flow direction of the hot medium (hot water or hot antifreeze), that is, as long as the medium flow pipeline is designed so that the medium can circulate and flow along the arrows shown in FIG. 2, is the specific flows not particularly limited. Similarly, the heat exchanger located in the cold source component is not specifically shown in FIG. 2, but it is not particularly limited as long as it can perform heat exchange between the medium and the cold source component.

Referring to FIG. 2, after the heating device 2200 of the heating system heats the medium to a certain temperature, the heated medium is made to flow to the heat exchangers located in the plurality of portions to be heated 2400 through the medium flow pipeline via the medium distribution portion 2300 under the action of the circulating pump, and the heat is exchanged between the medium and the plurality of portions to be heated 2400 as the cold source components through the heat exchangers. After the heat exchange is completed, the temperature of the cold source components increases, and the temperature of the medium decreases. The medium with lowered temperature flows into the medium converging portion 2500 to be centrally circulated back to the engine 2100, and then enters the heating device 2200, so as to realize the function of circulating heating of the medium.

In this way, the various operational components of the fracturing apparatus operating in cold areas can be heated to allow it to function properly.

The configuration in a case where only the heating device 2200 is used as the heat source has been described above. However, the generally configured heating device 2200 usually has limited power and weak circulation capacity. Due to the heat dissipation of the medium while flowing through the medium flow pipeline, the temperature of the medium flowing to the cold source components will decrease to some extent, and for some portions to be heated with large volume, the problems that the heating time will be too long, the temperature will rise too slowly and the like may be arise. In addition, there may also be a situation that the temperature of the medium near the heating device 2200 is relatively high, but the heating device 2200 stops when the predetermined temperature is not reached at the cold source components.

Figure 3:
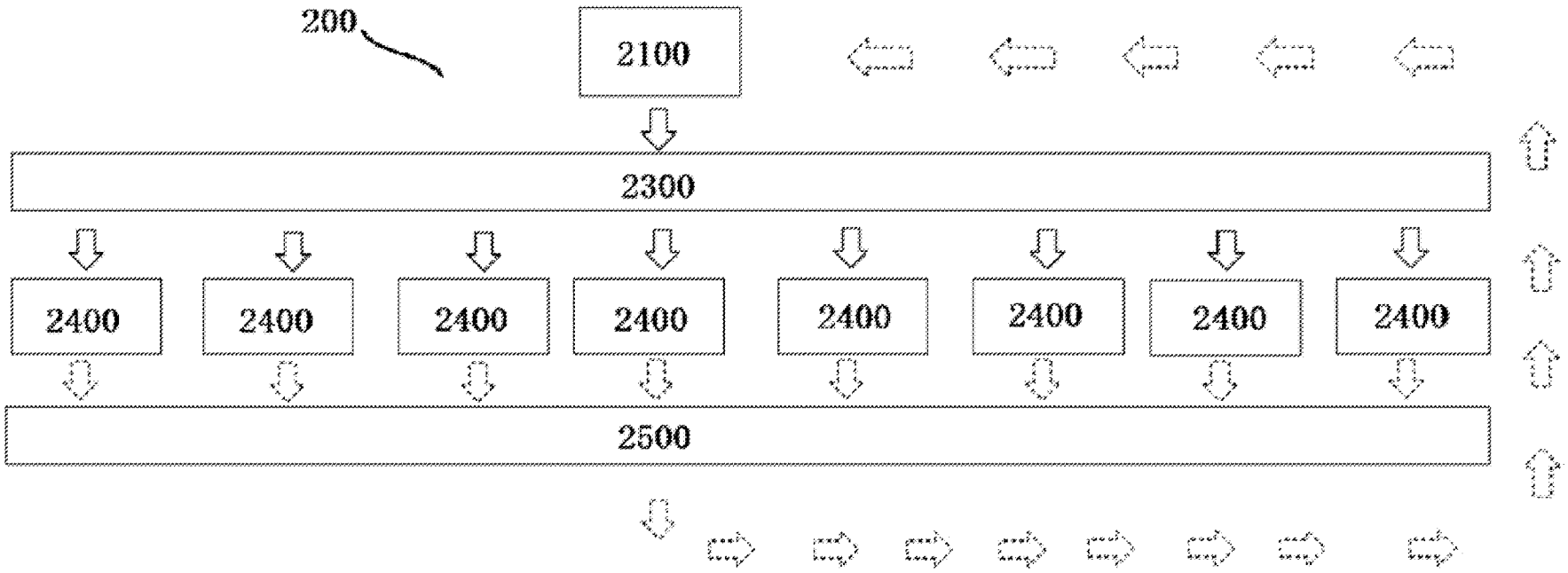
FIG. 3 is a schematic diagram illustrating an example fracturing apparatus employing a reverse heating system of the present disclosure.

In this case, the engine 2100 can be used as the heat source. In a case where the engine 2100 is used as the heat source, the schematic diagram of the structure of the turbine fracturing apparatus 200 can be shown in FIG. 3. Compared with FIG. 2, the heating device 2200 in FIG. 3 is bypassed outside the heating system, so it is not shown in FIG. 3. The parts in FIG. 3 with the same reference numerals as those in FIG. 2 denote components having the same function, and the description thereof will not be repeated here. Only the parts of FIG. 3 different from FIG. 2 will be described in detail below.

In FIG. 3, the engine 2100 is used as the heat source to heat each of the portions to be heated 2400 as cold source components. The heating device 2200 that is bypassed outside the heating system and is not shown in FIG. 3 may be used to heat the engine 2100 to a starting temperature to enable it to start before the engine 2100 is started. After the engine 2100 is started, the heating of the heating device 2200 may be turned off. After the engine 2100 is started, when the antifreeze rises to a certain temperature, the engine 2100 runs. At this time, the pressure and flow rate that the engine 2100 circulates the antifreeze are higher, and the temperature is higher. Therefore, the antifreeze circulated by the engine 2100 can be used to heat other cold source components. Since the engine 2100 acts as a cold source before starting, and becomes a heat source after starting, it can be called a reverse heating system. This will accelerate the heating. The engine 2100 acting as a heat source heats the antifreeze in a low temperature state to make it reach a certain high temperature state, and then the heated antifreeze is transferred to a plurality of portions to be heated 2400 (i.e. cold source components), where the heat is exchanged between the antifreeze and the cold source components, thereby increasing the temperature of the cold source components to achieve the purpose of heating. Here, similar to FIG. 2, the antifreeze circulated by the engine 2100 in FIG. 3 can also circulate in the direction of the arrow so as to realize the function of circulating heating.

As mentioned above, when the engine 2100 is used as a heat source for heating, the heating device 2200 is bypassed. This is because the pressure of the engine 2100 is much higher than that of the circulating pump of the heating device 2200. If it is not bypassed, the pressure of the circulating pump of the heating device 2200 may be too high, resulting in damage to the circulating pump of the heating device 2200.

The working principle of the antifreeze of the engine 2100 is to act as a heat dissipation medium to take away the heat generated by the combustion of the fuel, and then the heat is released to the outside by the radiator. The use of the reverse heating way can make secondary use of the heat generated by the engine 2100 itself, reducing energy consumption, indirectly improving the thermal efficiency of the engine 2100, reducing the load power of the radiator, and preventing the engine antifreeze temperature from being too high, which may affect the normal operation of the engine 2100. As can be seen, the use of the reverse heating way provides further beneficial technical effects.

The configuration in which the cold source components of the turbine fracturing apparatus 200 are heated in a forward heating manner by the heating device 200 or in a reverse heating manner by the engine 2100 is described above. It is to be noted that the present disclosure can also adopt both the forward heating way and the reverse heating way, which is called a dual heating system. That is to say, the heating device 2200 of the turbine fracturing apparatus 200 and the engine 2100 after starting running both can be used as the heat source to heat the relevant cold source components of the turbine fracturing apparatus 200. Specifically, both the heating device 2200 of the turbine fracturing apparatus 200 and the engine 2100 after starting running can be used to heat the antifreeze, so that the heating capacity and the heating rate are further improved. It is to be noted that, in a case of adopting the dual heating system, the circulating pump of the heating device 2200 needs to be able to withstand very high pressure, so there are certain requirements for its pressure bearing capacity. At the same time, it is to be noted that, the schematic diagram of the structure of the turbine fracturing apparatus 200 in the case of using the dual heating system is the same as that in FIG. 2, only the working principle is slightly different, that is, the engine 2100 and the heating device 2200 are both used to heat the medium. In a case that the turbine fracturing apparatus 200 is more inclined to have a higher heating rate and there is no particular limitation on the pressure bearing capacity of the circulating pump of the heating device 2200, the use of the dual heating system provides a preferred solution.

Figure 4:
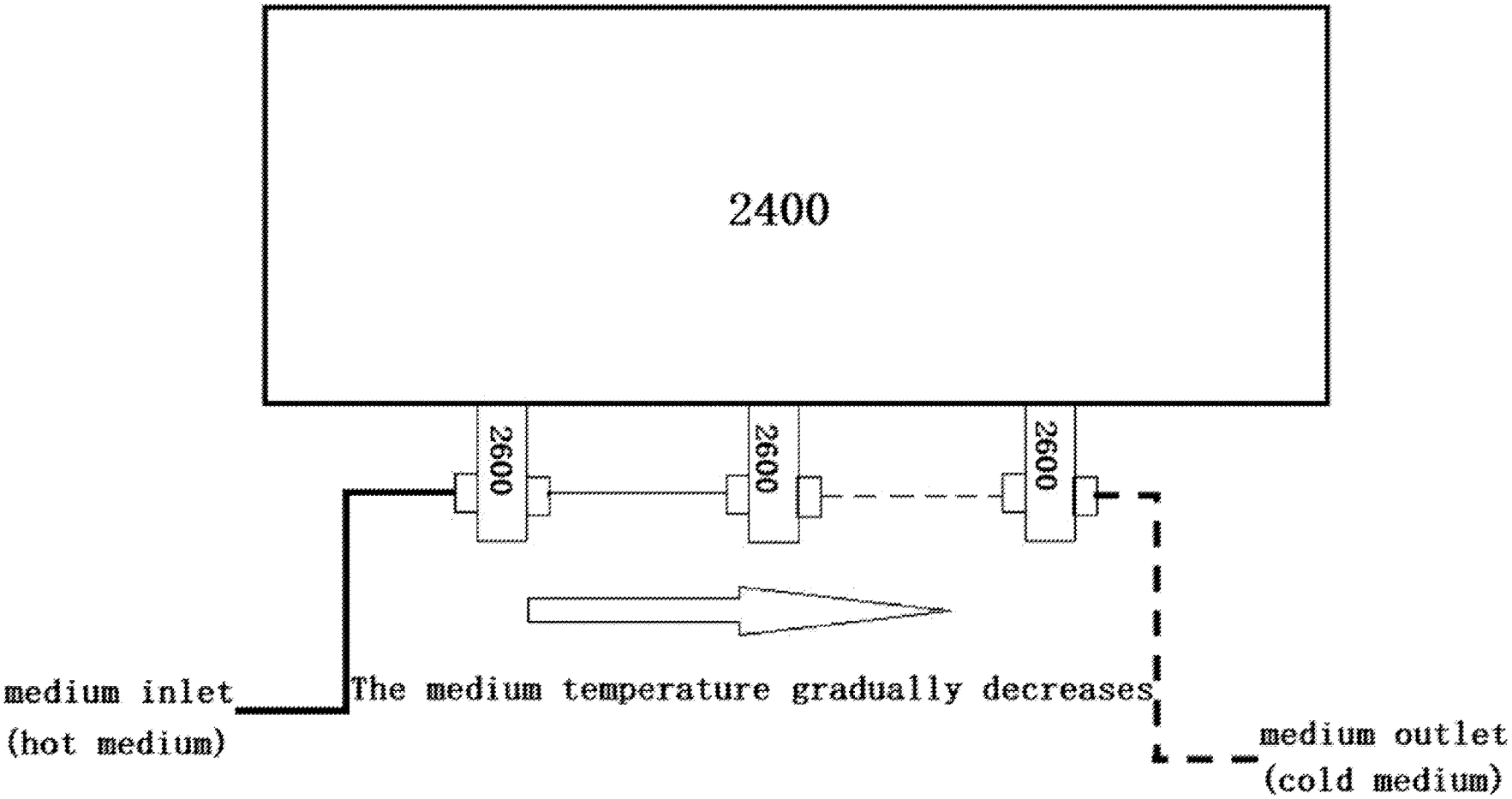
FIG. 4 is an example schematic diagram illustrating a cold source component heated in a series manner.
Figure 5:
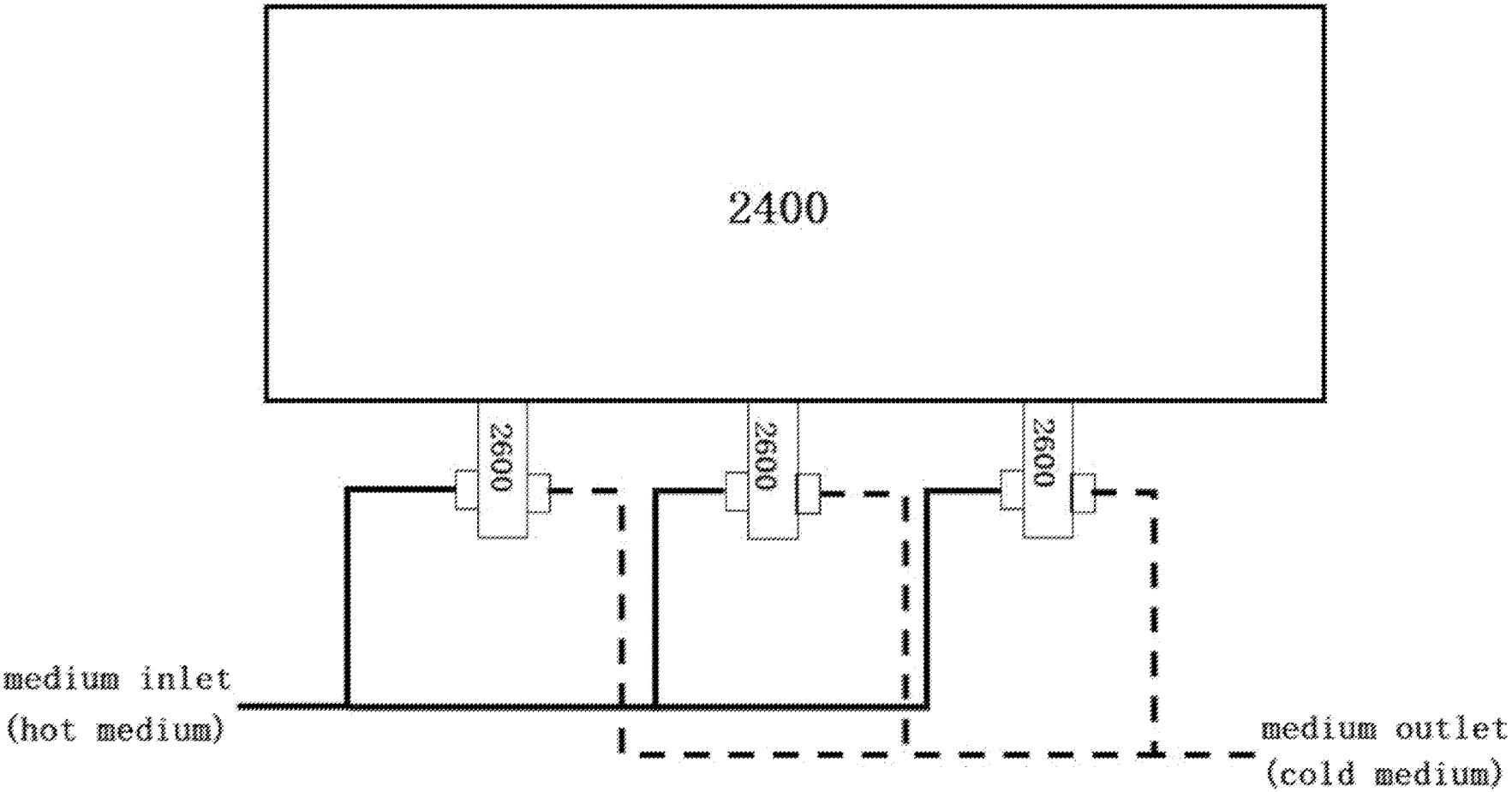
FIG. 5 is an example schematic diagram illustrating a cold source component heated in a parallel manner.

As mentioned above, the turbine fracturing apparatus 200 generally includes a plurality of portions to be heated 2400, and these portions to be heated 2400 may be lubricating oil, engine antifreeze, hydraulic oil, fuel oil, battery box, heat exchanger, air intake cabin of turbine engine and other heating portions. For example, the lubricating oil pump included in the auxiliary device 210 of the turbine fracturing apparatus 200 and the air intake cabin of the turbine engine 220 in FIG. 1. The heating load of each of the portions to be heated 2400 is generally different from each other. Assuming that one of the portions to be heated 2400 is a large-volume oil tank or the like that requires large heating load, it usually requires a plurality of heat exchangers 2600. In a case where these heat exchangers 2600 are connected in series as shown in FIG. 4, the temperature of the medium gradually decreases from the medium inlet to the medium outlet, such that the closer to the medium inlet the heat exchanger 2600 is, the higher the temperature of the heat exchanger 2600 is, and the closer to the medium outlet the heat exchanger 2600 is, the lower the temperature of the heat exchanger 2600 is. As a result, the medium such as oil in the portion to be heated 2400 cannot be uniformly heated. In this case, it is desirable to heat the portion to be heated 2400 with large load in a parallel manner as shown in FIG. 5. In a case of heating the portion to be heated 2400 in a parallel manner, due to the parallel connection among each of the heat exchangers 2600, the temperature of the inlet of each of the heat exchangers 2600 is the same, the heat exchange efficiency of each of the heat exchangers 2600 can be basically the same, and the efficiency of heat exchange can be improved. Thus, the medium such as oil can be heated more quickly. Therefore, it can bring better heating effect than that heating in a series manner.

On this basis, for a large-volume oil tank or the like that requires large heating load, the rapid heating can be achieved by increasing the number of heat exchangers 2600. However, since the oil is not in a flowing state, even if the number of heat exchangers 2600 is increased, the heating rate will not be particularly fast.

In this case, it is found that, when a structure such as a circulating pump 2700 is added for a large-volume oil tank or the like requiring large heating load, the oil can be heated while being circulated to increase the heating rate. Now, referring to FIG. 6 for detailed description, compared with FIG. 5, a circulating pump 2700 and two filters 2800 are added in FIG. 6. Here, the two ends of the circulating pump 2700 are respectively connected to the two ends (that is, one end being the liquid medium inlet and the other end being the liquid medium outlet) of the portion to be heated 2400 serving as an oil tank or the like. The two filters 2800 are respectively connected between the circulating pump 2700 and the portion to be heated 2400. The circulating pump 2700 is activated to circulate the oil in the portion to be heated 2400 while the portion to be heated 2400 is heated. In this way, the oil can be heated more quickly, and the oil can be heated more evenly, avoiding the situation that the heating effect of the oil near the heat exchanger is good, but the temperature of the oil in other locations is always low. Thereby, the heating efficiency is further improved.

Figure 6:
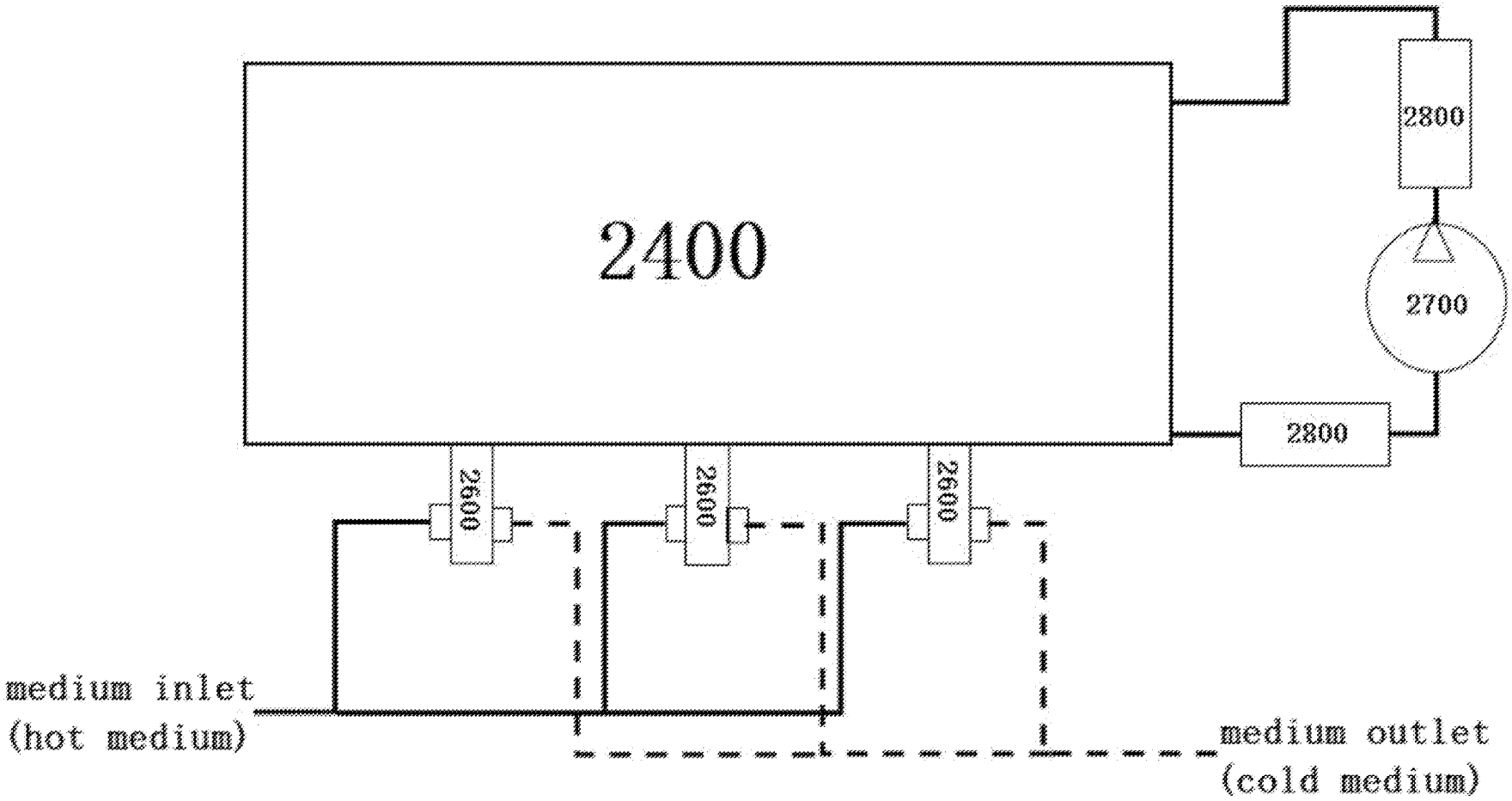
FIG. 6 is a schematic diagram illustrating a circulating pump being added on the basis of FIG. 5.
Figure 7:
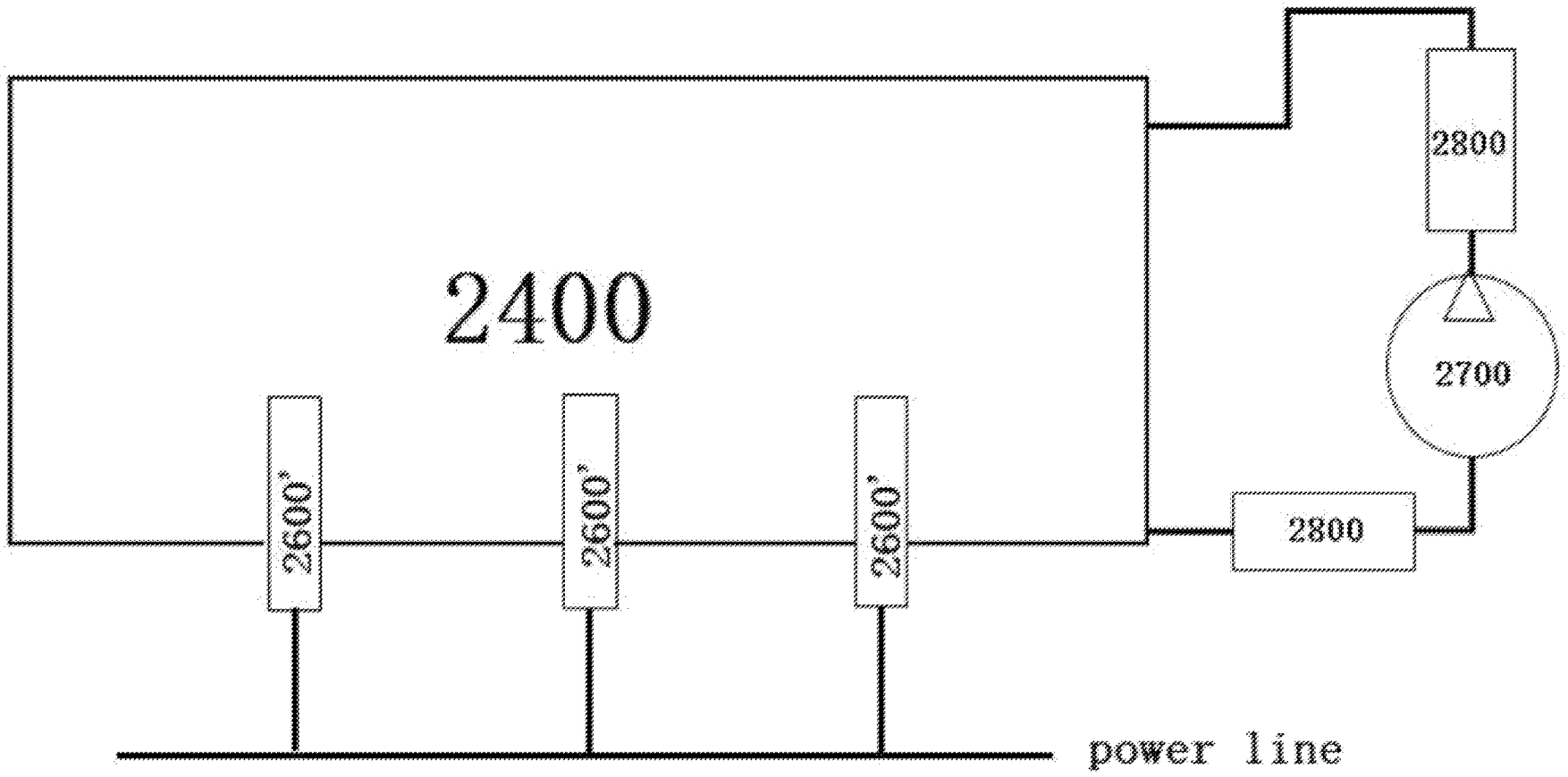
FIG. 7 is a schematic diagram illustrating a cold source component being heated in a parallel manner using instantaneous electric heaters.

In the above, as an example, a case in which the heating device 2200 and/or the engine 2100 are/is used as the heat source to heat the circulating medium so as to heat the portion to be heated 2400 requiring large heating load by the heat exchangers 2600 has been described referring to FIG. 6. However, it is to be noted that, in the configuration of FIG. 6, the heat exchangers 2600 in FIG. 6 can also be replaced with instantaneous electric heaters 2600'. In this case, the instantaneous electric heater 2600' may be powered by an electric motor included in the auxiliary device 210 of the turbine fracturing apparatus 200 of FIG. 1 as described above. There is no particular limitation on the instantaneous electric heater 2600' as long as it can heat the portion to be heated 2400 when supplied with power. There is no particular limitation on the instantaneous electric heater 2600' as long as it can heat the portion to be heated 2400 when power is supplied. This can refer to the schematic diagram shown in FIG. 7.

In addition, it is to be noted that, as described above, since the heating load of each of the portions to be heated 2400 is generally different from each other and the temperature required by each heating load is different, the heating time and heating rate of each heating load need to be individually controlled. In a case where each of the portions to be heated 2400 with different heating load is heated by heating medium, a valve block (such as a ball valve) may be provided at the medium converging portion 2500 shown in FIG. 2 to control whether the heating pipeline leading to each of the portions to be heated can be flowed through. It is to be noted that the ball valve can be set in a manual form, a hydraulic form, an electric form, or the like. A thermometer or a temperature sensor can be provided at each heating load to measure the temperature of each heating load, and an automatic control system can be provided for the heating system to automatically control the opening and closing of the ball valve. When the temperature measured by the thermometer or the temperature sensor is lower than a specific value, the result can be supplied to the automatic control system, and then the automatic control system can control the ball valve to automatically open to heat the corresponding load. On the other hand, when the temperature measured by the thermometer or temperature sensor reaches the required value, the result can also be supplied to the automatic control system, and then the automatic control system can control the ball valve to automatically close to stop heating the corresponding heating load. As mentioned above, the ball valve can be adjusted so as to control whether to heat the corresponding heating load.

Figure 8:
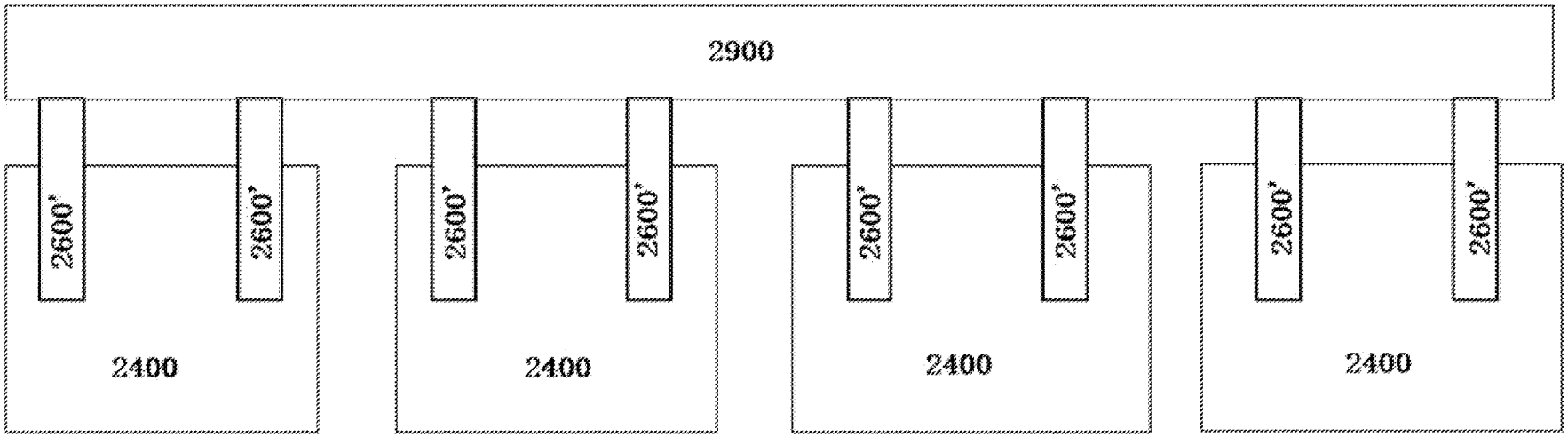
FIG. 8 is a schematic diagram illustrating automatically controlling the heating by instantaneous electric heaters.

Meanwhile, in a case where each of the portions to be heated 2400 are heated using the instantaneous electric heaters 2600' instead of the heated circulating medium, the electric heaters 2600' may be powered by an external power source to heat the heating load. In this case, the thermometer or temperature sensor may also be provided at each of the portions to be heated to measure the temperature of each of the portions to be heated. An automatic control system 2900 can also be provided for the electric heaters 2600', the automatic control system 2900 can automatically control the heating time and the temperature of each heating load 2400 by turning on or off each of the electric heaters 2600' or by adjusting the heating power of each of the electric heaters 2600' according to the temperature measured by the thermometer or the temperature sensor in each heating load so as to achieve the highest heating efficiency. This can refer to the schematic diagram of FIG. 8 of the present application.

As described above, the heating system of the present disclosure can heat the air intake cabin of the turbine engine as a cold source component. Next, the heating of the turbine engine 220 will be described in detail.

Figure 9:
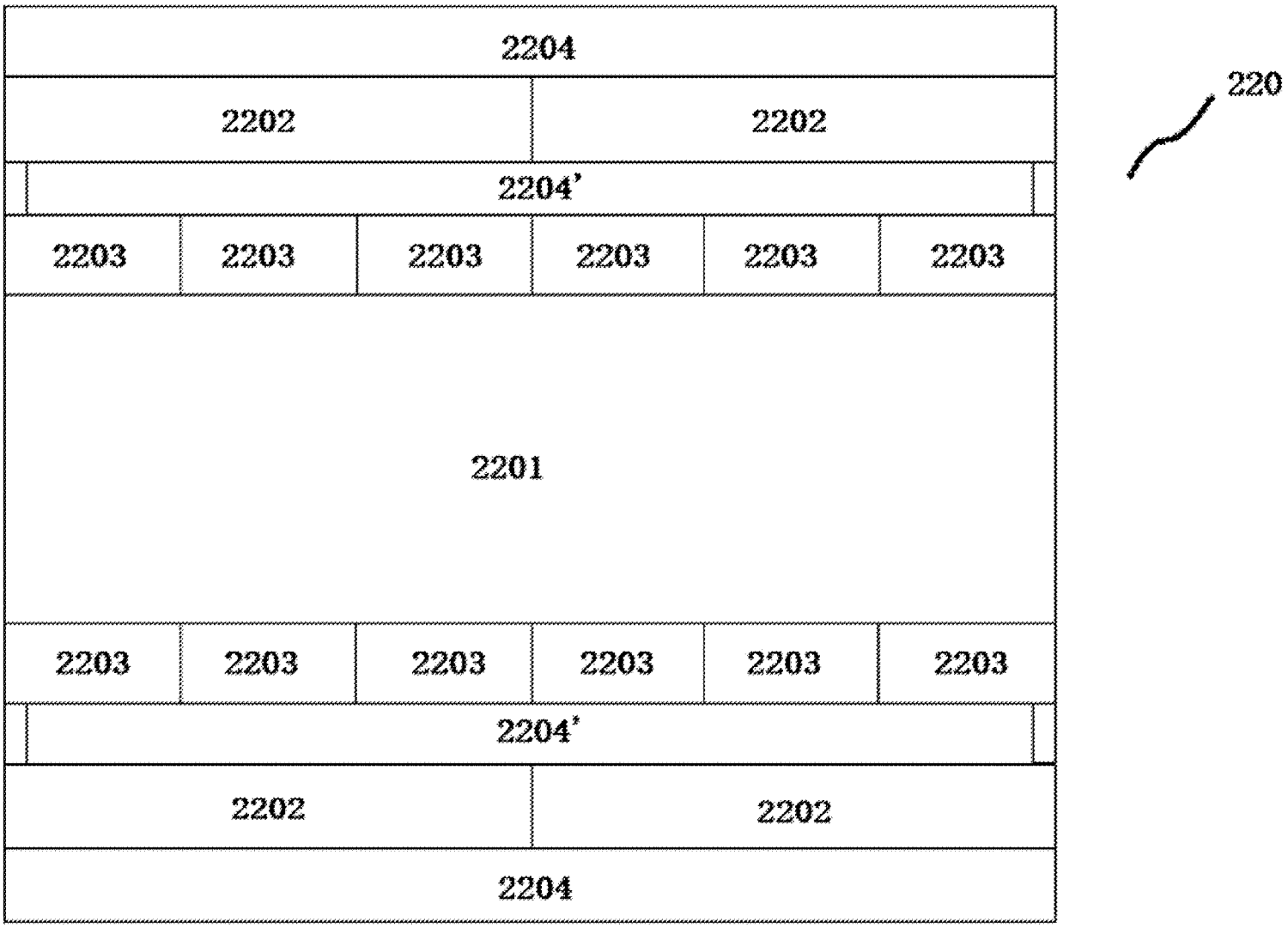
FIG. 9 is a schematic plan view illustrating the internal configuration of an example turbine engine.
Figure 10:
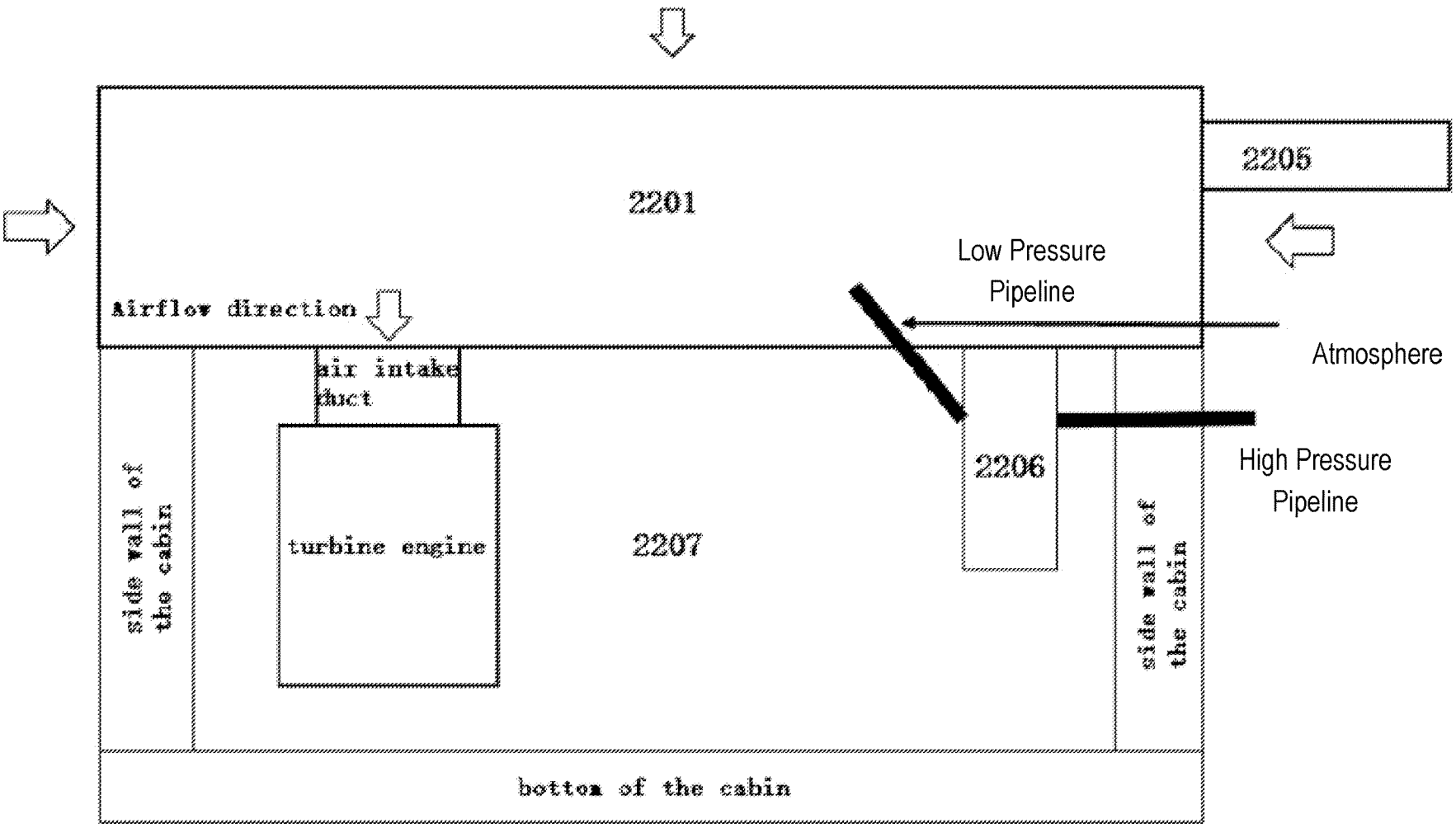
FIG. 10 is a schematic diagram illustrating the interior of the air intake cabin of an example turbine engine.

FIG. 9 is a schematic plan view illustrating the internal configuration of the turbine engine. FIG. 10 is a schematic diagram illustrating the interior of the air intake cabin of the turbine engine. As shown in the figures, the turbine engine 220 includes an air intake cabin 2201. The inertia separators 2202, filters 2203, a muffler (not shown in the figures) provided inside a muffler cabin 2207 and the like are arranged in the air intake cabin.

In a case of using the turbine engine 220, the turbine engine 220 has strict requirements for intake air in the cold season in winter. If the intake air temperature is low, the inertia separators 2202, the filters 2203 and the muffler in the muffler cabin 2207 in the air intake cabin of the turbine engine 220 are easily frosted, which will directly affect the intake air volume, create a high resistance to the intake air, and can have a severe negative impact on the operation of the turbine engine 220. Therefore, in a low temperature environment, a heating device needs to be provided on the air intake space of the turbine engine 220. The heating device may form a part of the heating system described above with reference to FIGS. 2 to 8. As mentioned above, the heating device may be an instantaneous electric heater that uses electricity for heating or a heat exchanger that uses circulating medium for heating. By means of the heating device, the temperature in the air intake cabin can reach above the freezing point, so that the intake air is heated up and the phenomenon of icing and frosting is avoided.

Referring to FIG. 9, in the air intake cabin 2201, the inertia separators 2202 and the filters 2203 are sequentially arranged along a direction from the outer side close to the cabin wall toward the center of the cabin. In this case, in the air intake cabin 2201, the heating device 2204 may be provided only at a position outside the inertia separator 2202 or the heating device 2204' may be provided only at a position between the inertia separator 2202 and the filter 2203. Alternatively, both the heating device 2204 and the heating device 2204' may also be provided at respective positions.

The use of the heating device 2204 and the heating device 2204' can be set according to the ambient temperature. Referring to FIG. 10, a temperature sensor 2205 and a differential pressure sensor 2206 may be provided at the air intake cabin 2201. The temperature sensor 2205 can detect the temperature of the environment. When the temperature sensor 2205 detects that the ambient temperature is higher than a certain set temperature, for example, 0° C., that is, it can be ensured that the inertia separators 2202, the filters 2203, the muffler in the muffler cabin 2207 and the like in the air intake cabin are not frozen or frosted, and it will not form an obstruction to the air entering the turbine engine 220, heating may not be performed. In addition, the differential pressure sensor 2206 can detect the air intake pressure differential of the air entering the air intake cabin 2201 from the environment, one end of which is arranged in the atmosphere (which can be called a high pressure part), and the other end is arranged inside the air intake cabin (which can be called a low pressure part due to the formed negative pressure). In normal operation, the difference between the two pressures is used to determine whether the filter elements of the filters 2203 are blocked (whether blocked by impurities such as dust), that is, the differential pressure sensor 2206 is used to detect whether the filters 2230 are blocked, and the data detected by the differential pressure sensor 2206 is used to determine whether the filter elements need to be replaced. On the other hand, in a low temperature environment in cold areas, the differential pressure sensor 2206 can also be used together with the temperature sensor 2205 to detect whether frost has formed inside the air intake cabin 2201 and whether the heating device needs to be activated to heat the air intake cabin 2201.

Figure 11:
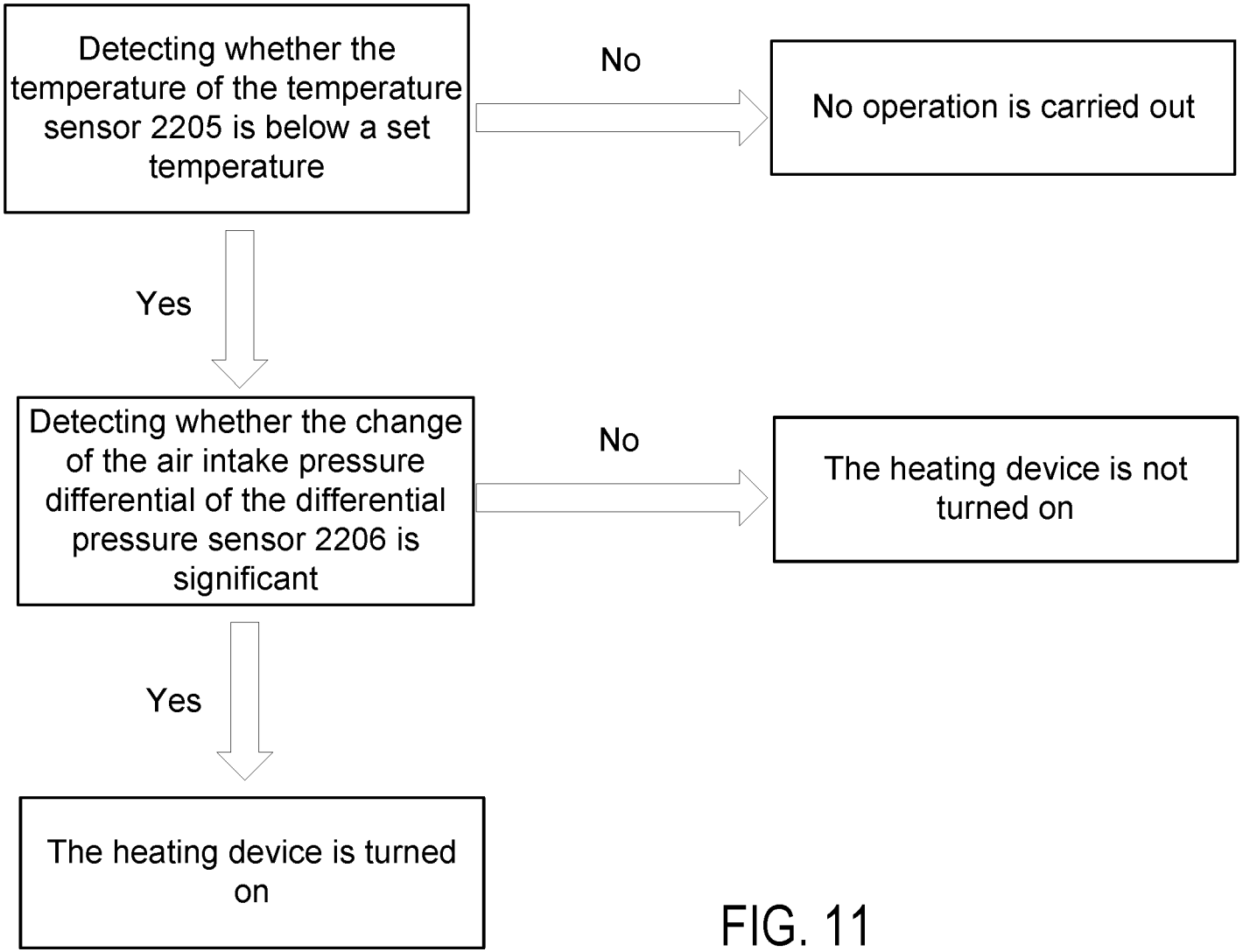
FIG. 11 is a flow diagram illustrating the heating of the interior of an example air intake cabin.

Referring to FIG. 11, the ambient temperature detected by the temperature sensor 2205 and the air intake pressure differential detected by the differential pressure sensor 2206 are used to set whether the heating device on the air intake cabin 2201 is turned on. When the temperature sensor 2205 detects that the ambient temperature is above a certain value/threshold (e.g. 0° C.), the heating device would not be put into operation. When the temperature sensor 2205 detects that the ambient temperature drops below a certain value (e.g. 0° C.), the change of the air intake pressure differential data of the differential pressure sensor 2206 is read at this time. If the air intake pressure differential data does not change significantly, the heating device may not be turned on, and if the air intake pressure differential data changes greatly in a short period of time (that is, indicating that the air intake resistance becomes larger), it can be determined that the inertia separators 2202, the filters 2203, the muffler in the muffler cabin 2207 and the like in the air intake cabin 2201 are frosted, which directly affects the air intake efficiency of the turbine engine 220. At this time, it is necessary to turn on the heating device to heat the air intake cabin 2201.

Figure 12:
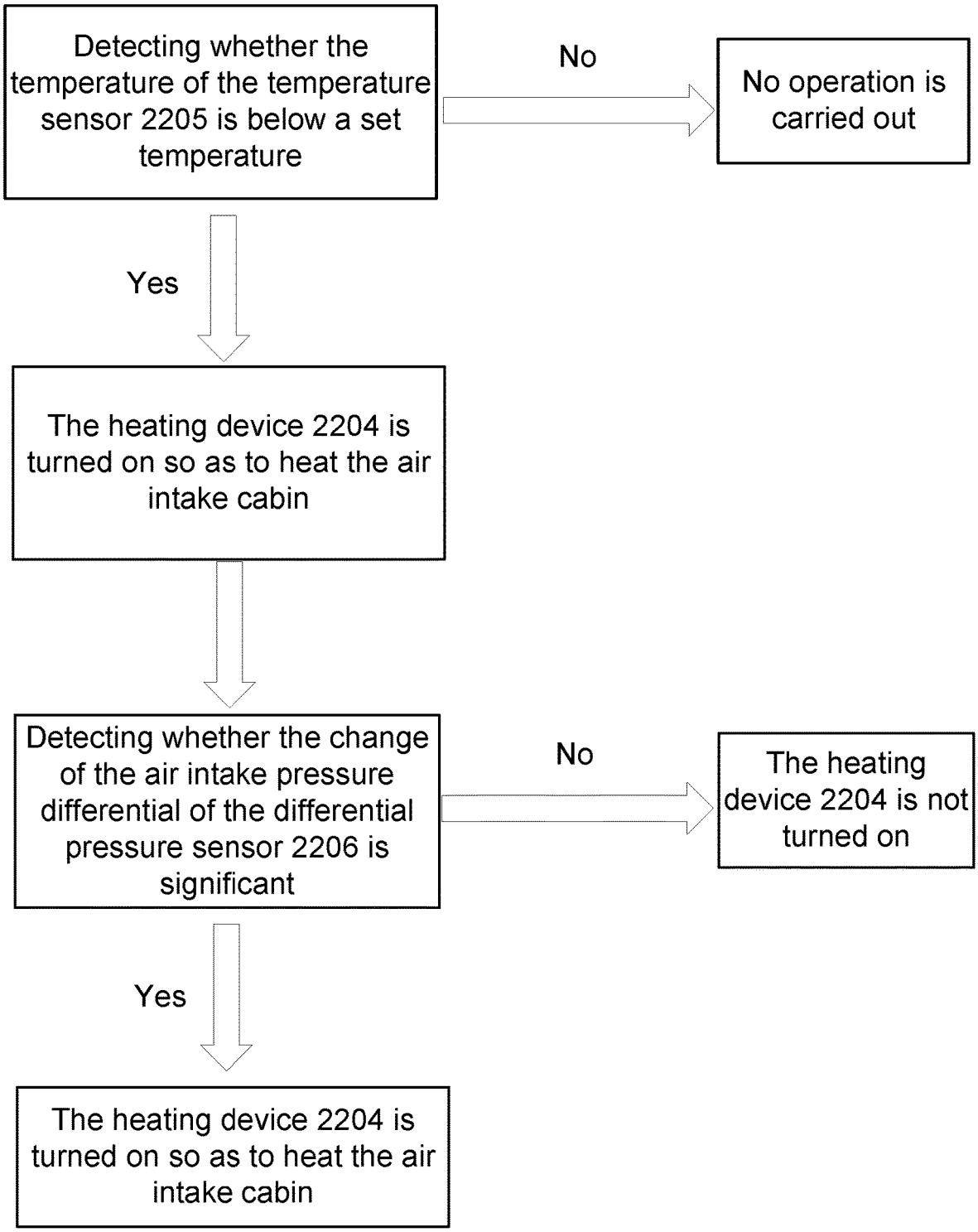
FIG. 12 is another flow diagram illustrating the heating of the interior of an example air intake cabin.

As shown in FIG. 9, when both the heating device 2204 and the heating device 2204' are provided, it can be controlled to turn on one of the heating device 2204 and the heating device 2204' or both according to actual needs. For example, referring to FIG. 12, when the ambient temperature detected by the temperature sensor 2205 does not reach below the set temperature, no heating device may be turned on, and when the ambient temperature detected by the temperature sensor 2205 is below the set temperature, that is, when the ambient temperature is lower than a certain set value, the heating device 2204 can be turned on first, so that the temperature of the air entering the air intake cabin 2201 reaches a certain temperature without causing frosting on the devices. On the other hand, when the ambient temperature detected by the temperature sensor 2205 drops further, the air intake pressure differential detected by the differential pressure sensor 2206 can be used to determine whether frost is formed in the air intake cabin 2201. If it is determined that there is no frost in the air intake cabin 2201, the heating device 2204' may not be turned on, and if it is determined that frost is formed in the air intake cabin 2201, it means that the capacity of the heating device 2204 is not enough to remove frost at a further reduced ambient temperature. At this time, the heating inside the air intake cabin 2201 can be achieved by turning on the heating device 2204'. Ultimately, it is ensured that the intake air flow of the turbine engine 220 meets the requirements. It is ensured that the output power of the turbine engine 220 will not drop due to the drop of the ambient temperature and the turbine engine 220 can work normally.

In this way, the normal operation of the turbine engine 220 in cold areas can be guaranteed.

It is to be noted that the terms used herein are for the purpose of describing specific embodiments only, and are not intended to limit the exemplary embodiments according to the present application. As used herein, the singular form is also intended to include the plural form unless otherwise specified. In addition, it should also be understood that, when the terms "comprising" and/or "including" are used in this specification, it indicates the presence of features, steps, acts, means, components, and/or combinations thereof.

It is to be noted that the terms "first", "second", etc. in the description and claims and the drawings above of the present application are used to distinguish similar objects, and are not necessarily used to describe a specific sequence. It should be understood that the data thus used may be interchanged under appropriate circumstances so that the embodiments of the present application described herein can be practiced in sequences other than those illustrated or described herein.

The above description is only illustrative, but not limited, and for those skilled in the art, various modifications and variations of the present disclosure can be made. Any modification, equivalent replacement, improvement, etc. made within the spirit and principle of the present disclosure shall be included within the protection scope of the present disclosure.

The invention claimed is:

1. A fracturing apparatus (200), comprising:

a plurality of portions to be heated (2400);

a turbine engine comprising an air intake cabin and inertia separators (2202) and filters (2203) sequentially arranged along a direction from an outer side close to a cabin wall toward a center of the air intake cabin (2201);

a heating system for heating each of the plurality of portions to be heated (2400); and an auxiliary power unit (210), which is configured to at least provide power for a heating operation by the heating system, wherein the heating system includes a heating device (2204, 2204') provided in the air intake cabin (2201), and the heating device (2204, 2204') is provided at a position outside the inertia separators (2202) or at a position between the inertia separators (2202) and the filters (2203).

2. The fracturing apparatus (200) according to claim 1, wherein:

the heating system includes the heating device (2200) as a heat source.

3. The fracturing apparatus (200) according to claim 2, wherein:

the auxiliary power unit (210) comprises an electric motor;

the heating device (2200) comprises an electric heater that is in direct contact with each of the plurality of portions to be heated (2400) so as to heat each of the plurality of portions to be heated (2400); and the electric motor is configured to power the electric heater.

4. The fracturing apparatus (200) according to claim 2, wherein:

the auxiliary power unit (210) comprises an engine; and the heating device (2200) comprises an electric heater, a gas heater or an oil heater that heats each of the plurality of portions to be heated (2400) by heating a circulating medium.

5. The fracturing apparatus (200) according to claim 4, wherein:

the engine and/or the heating device (2200) are/is used as a heat source of the heating system.

6. The fracturing apparatus (200) according to claim 5, wherein:

the heating system further includes a medium flow pipeline and a circulating pump;

the circulating medium comprises antifreeze or water;

the circulating medium is heated by the heat source to change into a hot medium;

the hot medium is driven to flow to each of the plurality of portions to be heated (2400) through the medium flow pipeline by the circulating pump so as to heat each of the plurality of portions to be heated (2400); and the hot medium cools into a cold medium after heating each of the portions to be heated (2400), then returns to the engine and is heated again by the heat source for circular heating.

7. The fracturing apparatus (200) according to claim 6, wherein:

the heating system further includes a medium distribution portion (2300) and a medium converging portion (2500);

the hot medium is distributed to each of the plurality of portions to be heated (2400) through the medium distribution portion (2300); and the cold medium flows into the medium converging portion (2500) to be centrally circulated back to the engine.

8. The fracturing apparatus (200) according to claim 7, wherein:

the heating system further includes an automatic control system (2900), which can automatically control a heating of each of the plurality of portions to be heated (2400).

9. The fracturing apparatus (200) according to claim 8, wherein:

each of the plurality of portions to be heated (2400) is provided with a temperature sensor, and the automatic control system (2900) can automatically control the heating of each of the plurality of portions to be heated (2400) through a temperature measured by the temperature sensor.

10. The fracturing apparatus (200) according to claim 8, wherein:

each of the plurality of portions to be heated (2400) is provided with a temperature sensor;

a ball valve is provided at the medium converging portion (2500);

the ball valve is configured to control a flow of a heating pipeline for each of the plurality of portions to be heated (2400);

the automatic control system (2900) is configured to automatically control an opening and closing of the ball valve according to a temperature measured by the temperature sensor, so as to automatically control the heating of each of the plurality of portions to be heated.

11. The fracturing apparatus (200) according to claim 2, wherein:

each of the plurality of portions to be heated (2400) is heated in a series manner or a parallel manner.

12. The fracturing apparatus (200) according to claim 11, wherein:

the heating device (2200) comprises a plurality of electric heaters that are in direct contact with each of the plurality of portions to be heated (2400) so as to heat each of the plurality of portions to be heated (2400) and the plurality of electric heaters are connected in series or in parallel; or the heating device (2200) comprises a plurality of heat exchangers that heat each of the plurality of portions to be heated (2400) by heating a circulating medium, and the plurality of heat exchangers are connected in series or in parallel.

13. The fracturing apparatus (200) according to claim 12, wherein:

when a portion of the plurality of portions to be heated (2400) is a liquid medium, the portion to be heated (2400) is further provided with a circulating pump (2700);

one end of the circulating pump (2700) is connected to a liquid medium outlet of the portion to be heated (2400), and the other end of the circulating pump (2700) is connected to a liquid medium inlet of the portion to be heated (2400), so that the liquid medium is configured to circulate through the circulating pump (2700) while being heated.

14. The fracturing apparatus (200) according to claim 13, further comprising two filters (2800) provided between the circulating pump (2700) and the portion to be heated (2400), wherein one of the filters (2800) is provided between the one end of the circulating pump and the liquid medium outlet of the portion to be heated (2400), and another one of the filters (2800) is provided between the other end of the circulating pump (2700) and the liquid medium inlet of the portion to be heated (2400), so that solid impurities in the liquid medium are filtered out so as to prevent clogging of the circulating pump (2700).

15. The fracturing apparatus (200) according to claim 1, wherein:

the plurality of portions to be heated (2400) comprise lubricating oil, engine antifreeze, hydraulic oil, fuel oil, battery box, heat exchanger, and air intake cabin of turbine engine.

16. The fracturing apparatus (200) according to claim 1, wherein:

the air intake cabin (2201) is further provided with a temperature sensor (2205) and a differential pressure sensor (2206);

the temperature sensor (2205) is configured to detect a temperature of an environment of the fracturing apparatus; and the differential pressure sensor (2206) is configured to detect an air intake pressure differential of air entering the air intake cabin (2201) from the environment.

17. The fracturing apparatus (200) according to claim 16, wherein:

the fracturing apparatus (200) further includes an automatic control system (2900); and the automatic control system (2900) automatically controls the heating operation by the heating device (2204, 2204') according to the temperature measured by the temperature sensor (2205) and the air intake pressure differential measured by the differential pressure sensor (2206).

18. The fracturing apparatus (200) according to claim 1, wherein:

the heating device (2204, 2204') comprises instantaneous electric heaters or heat exchangers for heating with a circulating medium.

* * * * *